US011786060B1

(12) United States Patent
Ward et al.

(10) Patent No.: US 11,786,060 B1
(45) Date of Patent: Oct. 17, 2023

(54) PRINT HANGER

(71) Applicant: Silicate Studio Home, LLC, Rexburg, ID (US)

(72) Inventors: Jeff Ward, Rolling Hills, ID (US); Riley Plocher, Rexburg, ID (US)

(73) Assignee: Silicate Studio Home, LLC, Rexburg, ID (US)

( * ) Notice: Subject to any disclaimer, the term of this patent is extended or adjusted under 35 U.S.C. 154(b) by 0 days.

(21) Appl. No.: 17/846,328

(22) Filed: Jun. 22, 2022

(51) Int. Cl.
*A47G 1/16* (2006.01)
*A47G 1/22* (2006.01)

(52) U.S. Cl.
CPC ..... *A47G 1/162* (2013.01); *A47G 1/22* (2013.01)

(58) Field of Classification Search
CPC ..... A47G 1/162; A47G 1/22
USPC ..... 40/711, 621, 757, 758, 759; 248/467, 248/470, 480, 494, 497, 498
See application file for complete search history.

(56) References Cited

U.S. PATENT DOCUMENTS 3,553,872 A * 1/1971 Ebner ..... G09F 1/12 40/721
3,665,628 A 5/1972 Dammond
4,255,837 A 3/1981 Holtz
4,356,647 A * 11/1982 Farris ..... G09F 15/02 D6/300
4,459,773 A * 7/1984 Sandlin ..... G09F 15/02 40/739
D424,120 S 5/2000 Wear
7,219,460 B1 * 5/2007 Grayson ..... A47G 1/06 40/711
7,261,269 B2 8/2007 Cote
7,823,311 B2 11/2010 Pitcher et al.
8,904,688 B1 * 12/2014 Rue ..... B44D 3/185 40/781
8,959,817 B1 * 2/2015 Barnes ..... A47G 1/06 40/711
10,000,087 B2 6/2018 Pedersen
10,244,875 B1 * 4/2019 Lydon ..... G09F 17/00
10,307,000 B2 * 6/2019 Ward ..... A47G 1/162
10,803,777 B1 * 10/2020 Moody ..... A47G 1/0638
11,363,896 B2 * 6/2022 Hong ..... A47G 1/065
2003/0121193 A1 * 7/2003 Kim ..... A47G 1/06 40/711
2005/0028417 A1 * 2/2005 Kim ..... A47G 1/14 40/711

(Continued)

FOREIGN PATENT DOCUMENTS

GB 2445969 A * 7/2008 ..... G09F 7/02
WO WO-2008049937 A1 * 5/2008 ..... G09F 7/04

OTHER PUBLICATIONS

National Galleries Scotland, "Magnetic Wooden Poster Hander (White A2)," 5 pgs., https://www.nationalgalleries.org/shop/prints-and-posters/framed-prints/magnetic-wooden-poster-hanger-white-a2.

(Continued)

*Primary Examiner* — Kimberly T Wood
(74) *Attorney, Agent, or Firm* — Thorpe North & Western, LLP.

(57) ABSTRACT

A print is hung on a wall with a print hanger that has a bracket and a cover plate. The bracket is mounted to a wall and carries the cover plate. The cover plate has magnets that align with lobes of the bracket to clamp an edge of the print and secure the cover plate to the bracket. The cover plate has a pocket to receive and hide the bracket.

18 Claims, 4 Drawing Sheets

(56) References Cited

U.S. PATENT DOCUMENTS

| | | | | |
|---|---|---|---|---|
| 2007/0289182 | A1* | 12/2007 | Reinold | G09F 7/04 40/594 |
| 2013/0160338 | A1* | 6/2013 | Forbis | A47G 1/06 40/711 |
| 2016/0073796 | A1* | 3/2016 | Nesbitt | G09F 7/04 40/711 |
| 2016/0360903 | A1* | 12/2016 | Knowlden | G09F 15/0012 |
| 2017/0360225 | A1* | 12/2017 | Kim | A47G 1/143 |
| 2020/0138208 | A1 | 5/2020 | Morriss et al. | |
| 2020/0154910 | A1* | 5/2020 | Ward | A47G 1/162 |
| 2022/0233000 | A1* | 7/2022 | Spiro | A47G 1/0611 |
| 2022/0265069 | A1* | 8/2022 | Spiro | A47G 1/1686 |

OTHER PUBLICATIONS

Amazon, "Magnetic Poster Hanger Frame 24—Premium Quality Wood, Extra Strong Magnets, Quick & Easy Setup, Full Hanging Kit for Wall Art/Prints/Canvas/Photos/Pictures/Art work/Scratch Map (24x17 24x20 24x36)," 22 pgs., https://www.amazon.com/Magnetic-Poster-Hanger-Frame-25/dp/B0822FFMTQ?th=1).

Vistaprint, "Poster Rails," 3 pgs., https://www.vistaprint.com/signs-posters/accessories/poster-rails?qty =1& Material=Plastic&Size=11%22%20x%2017%22&utm_id=2B08494812790763961909&coupon=&partner=google&ps_vtp=16192639625|134896040282||pla-1658834150114|c|9029748||g&ps_vtp2=g|||581748469120||pla|1658834150114|posterRails|11732&gclid=Cj0KCQjw1ZeUBhDyARIsAOzAgQKGRSFVewh95Grz5x2TWsQXZdPJX6GZe-BDNpsKNpD8UU1tlym7OMkaAib0EALw_wcB ).

* cited by examiner

PRINT HANGER

BACKGROUND

Posters or prints can be hung on a wall using top and bottom rails that engage the top and bottom of the poster or print, respectively. Some rails have a channel that grip the edges of the poster or print. Some rails have two bars that magnetically attach to one another, pinching the edges of the poster or print. Some rail systems are complicated while other systems are aesthetically displeasing. The development of poster or print hanging solutions is an ongoing endeavor.

BRIEF DESCRIPTION OF THE DRAWINGS

Features and advantages of the invention will be apparent from the detailed description which follows, taken in conjunction with the accompanying drawings, which together illustrate, by way of example, features of the invention; and; wherein.

Figure 1:
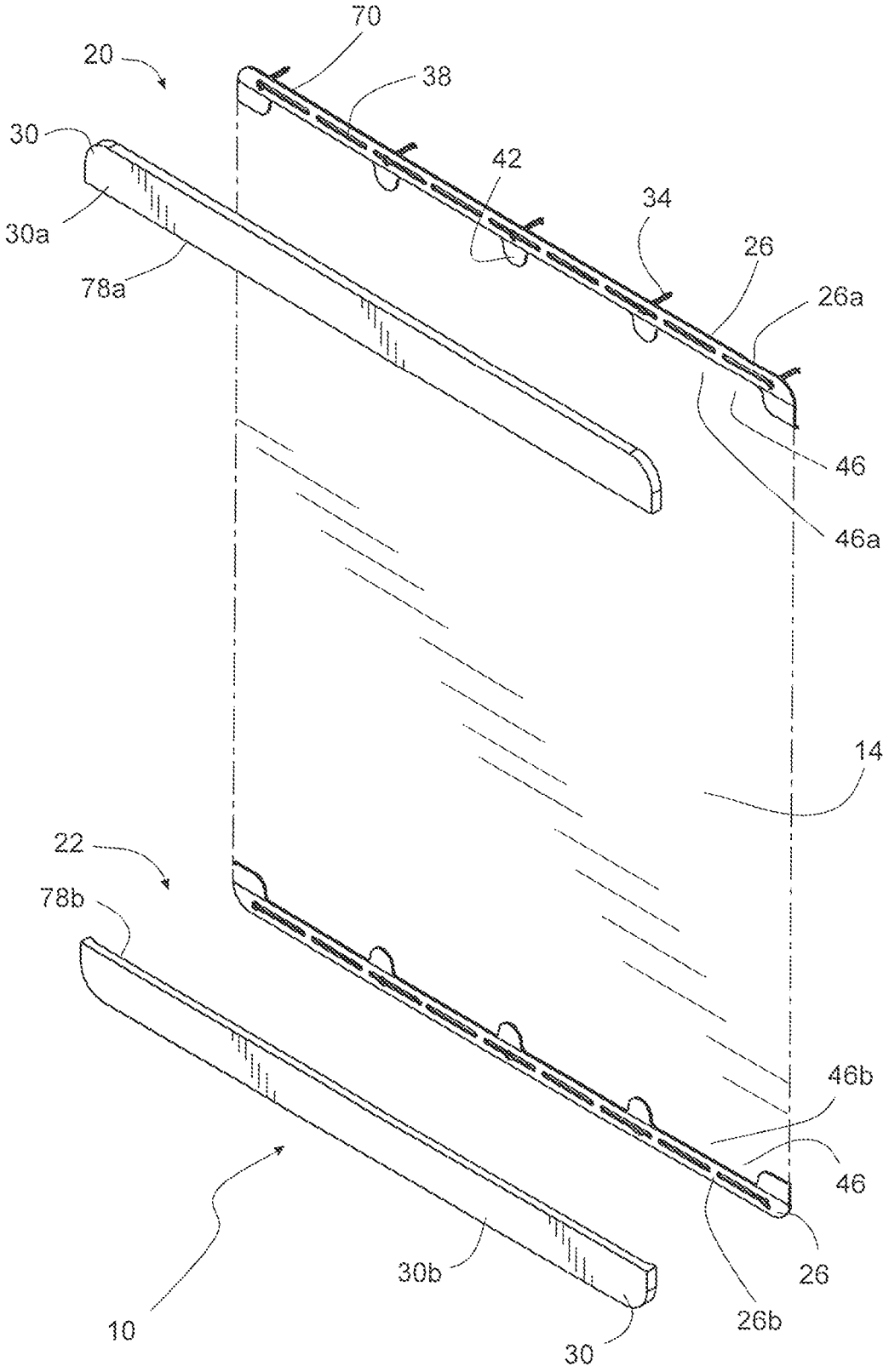
FIG. 1 is an exploded perspective view of a print hanger in accordance with an embodiment of the invention, shown with a print.
Figure 4:
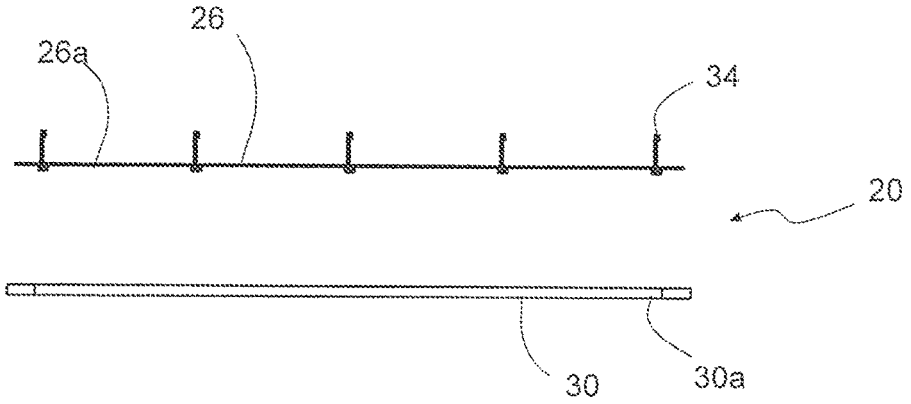
FIG. 4 is an exploded top view of the print hanger of FIG. 1.
Figure 2:
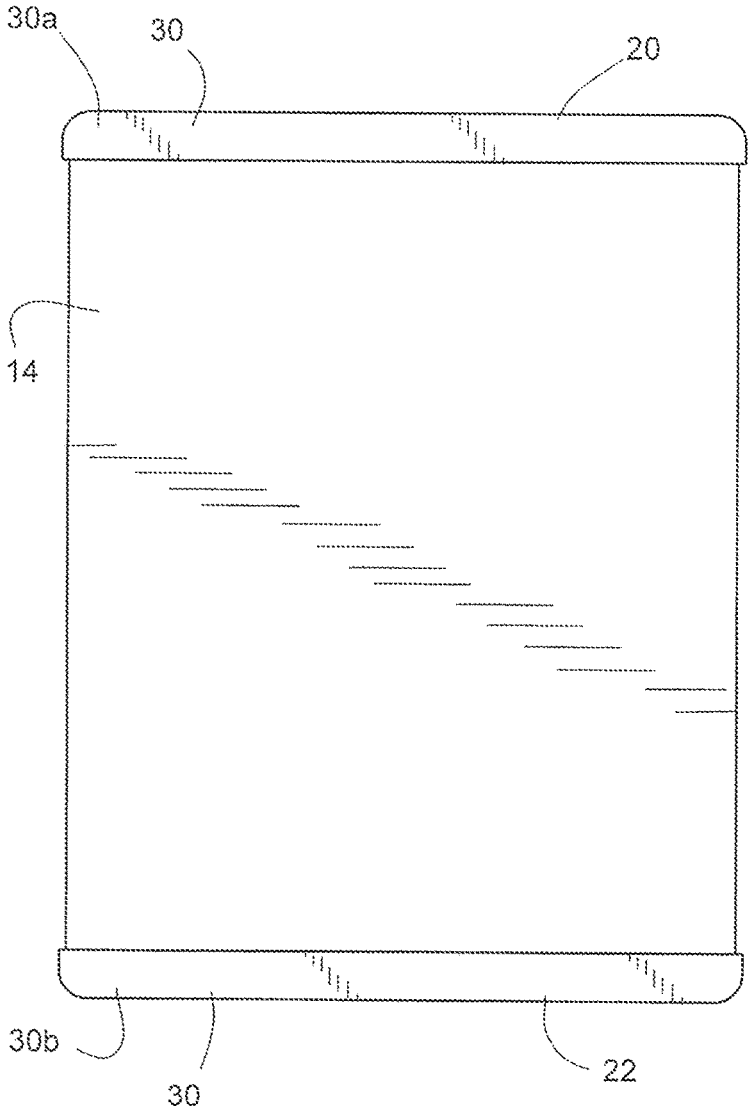
FIG. 2 is front view of the print hanger of FIG. 1, shown with the print.

Reference will now be made to the exemplary embodiments illustrated, and specific language will be used herein to describe the same. It will nevertheless be understood that no limitation of the scope of the invention is thereby intended.

DETAILED DESCRIPTION

Before invention embodiments are disclosed and described, it is to be understood that no limitation to the particular structures, process steps, or materials disclosed herein is intended, but also includes equivalents thereof as would be recognized by those ordinarily skilled in the relevant arts. It should also be understood that terminology employed herein is used for the purpose of describing particular examples only and is not intended to be limiting. The same reference numerals in different drawings represent the same element. Numbers provided in flow charts and processes are provided for clarity in illustrating steps and operations and do not necessarily indicate a particular order or sequence. Unless defined otherwise, all technical and scientific terms used herein have the same meaning as commonly understood by one of ordinary skill in the art to which this disclosure belongs.

An initial overview of the inventive concepts are provided below and then specific examples are described in further detail later. This initial summary is intended to aid readers in understanding the examples more quickly, but is not intended to identify key features or essential features of the examples, nor is it intended to limit the scope of the claimed subject matter.

The present application provides an example of a print hanger for mounting or hanging a print to a flat vertical surface, such as a wall. The print can be a flat sheet, such as a poster, a sheet of canvas, a sheet of fabric, etc. Examples and configurations disclosed herein provide a pair of hangers, such as upper and lower hangers, that can hold the print from the top and bottom and taut therebetween. In addition, examples and configurations disclosed herein provide a bracket for mounting to the wall, and a cover plate for sandwiching an edge of the print between the cover plate and the bracket, and to cover and hide the bracket.

When decorating a room, a consumer may wish to hang a print on one or more walls in order to display the print and decorate the room. Some print hangers are commercially available. Many such print hangers have complicated channels and inserts. Other print hangers have identical front and back pieces that can be thick such that the print is spaced farther from the wall. Some print hangers have visible components that can distract from the print.

The print hanger designed in accordance with the design principles described in the present disclosure provide discrete hangers with the cover plate covering and hiding the bracket. In one aspect, the bracket can be thin to position the print closer to the wall. In another aspect, the cover plate can substantially surround the bracket so that it is not visible. In another aspect, brackets and cover plates can be provided with different widths to accommodate different sized prints.

Figure 3:
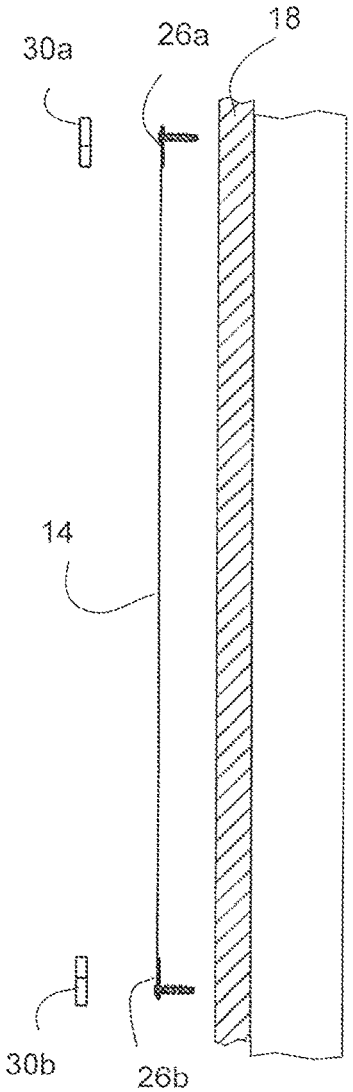
FIG. 3 is an exploded side view of the print hanger of FIG. 1, shown hanging the print on a wall.
Figure 5:
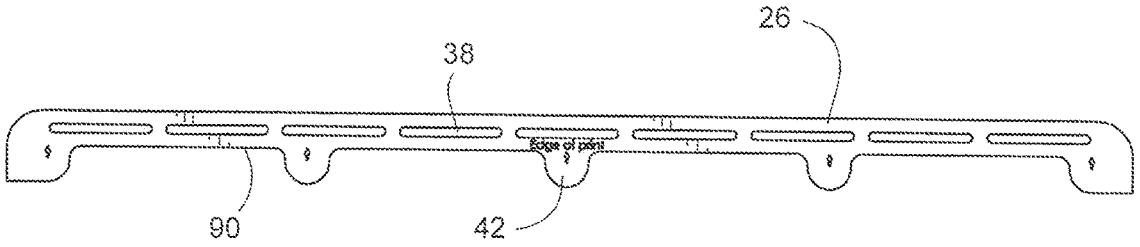
FIG. 5 is a front view of a bracket of the print hanger of FIG. 1.
Figure 7:
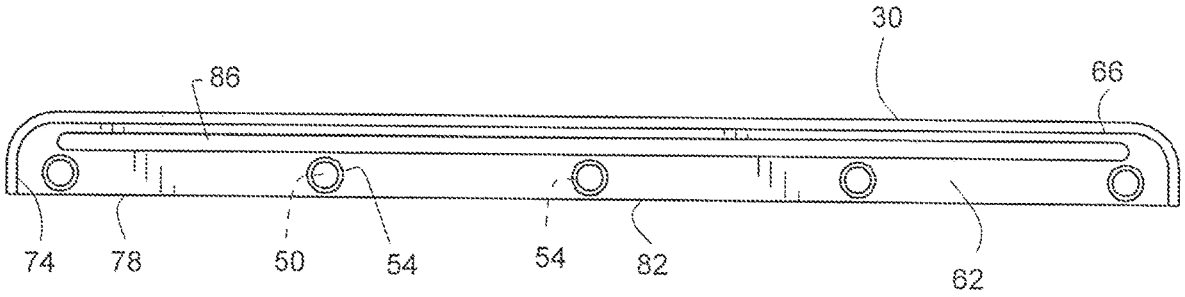
FIG. 7 is a back view of the cover plate of the print hanger of FIG. 1.
Figure 10:
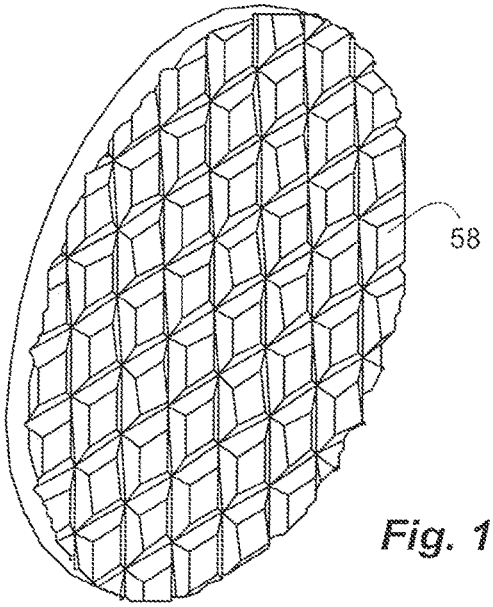
FIG. 10 is a perspective view of a grip pad of the hanger of FIG. 1.
Figure 6:
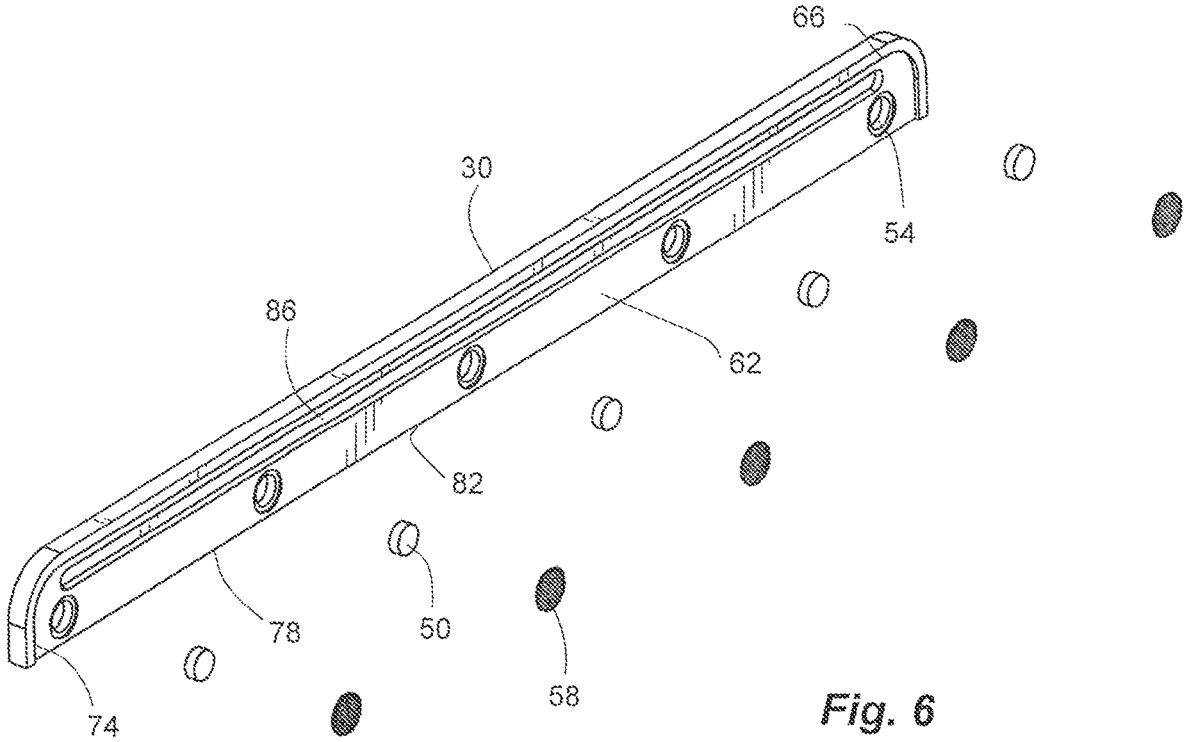
FIG. 6 is an exploded perspective view of a cover plate of the print hanger of FIG. 1.
Figure 8:
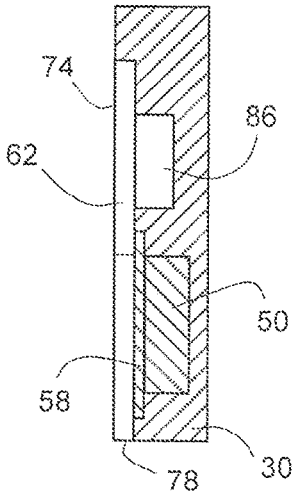
FIG. 8 is a cross-sectional side view of the cover plate of the print hanger of FIG. 1.
Figure 9:
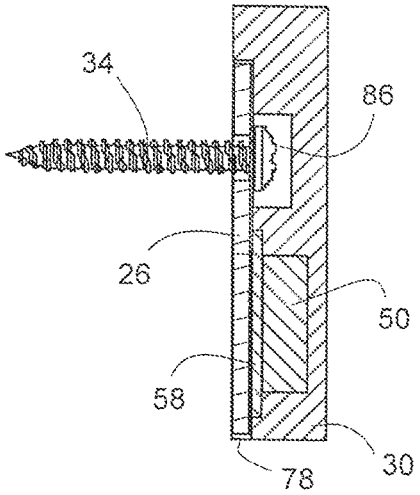
FIG. 9 is a cross-sectional side view of the hanger of FIG. 1.

Referring to FIGS. 1-10, a print hanger 10 is shown in an exemplary embodiment for mounting or hanging a print 14 on a wall 18 (FIG. 3). The wall 18 can have a wall panel, such as drywall, covering studs. The wall panel can have a finished surface, such as painted. The studs and the wall panel can be vertically oriented and can extend from a support surface, such as the floor, to a ceiling. The print hanger 10 is mounted to and carried by the wall 18. In one aspect, the print hanger 10 can comprise an upper hanger 20 and a lower hanger 22 mounted to the wall 18. In another aspect, the print hanger 10 can comprise a single hanger, such as the upper hanger 20. In another aspect, the hangers 20 and 22 can also be mounted through the drywall and to the studs. In one aspect, each hanger 20 and 22 can be mounted to multiple studs. The print 14 is mounted to and carried by the hangers 20 and 22.

Each hanger 20 and 22 can comprise a bracket 26 and a cover plate 30. Thus, the print hanger 10 can comprise a pair of brackets, such as an upper bracket **26*a* and a lower bracket 26*b* that are separate from one another. The brackets 26*a* and 26*b* are mounted to the wall 18 in a spaced-apart relationship with the upper bracket 26*a* mounted over the lower bracket 26*b*. The brackets 26*a* and 26*b* can be mounted to the wall 18 with fasteners 34, such as screws or nails. In one aspect, each bracket 26*a* and 26*b* can have an array of slots 38 extending through the bracket 26*a* and 26*b* and along a length of the bracket 26*a* and 26*b* to receive the fasteners 34 and to mount the brackets 26*a* and 26*b* to the wall 18**.

In addition, each bracket **26*a* and 26*b* can comprising an array of lobes 42 extending from the bracket 26*a* and 26*b*. The brackets 26*a* and 26*b* can be oriented with the lobes 42 extending towards the other bracket 26*a* and 26*b* when mounted on the wall 18. Thus, the lobes 42 of the upper bracket 26***a* can extend downward, while the lobes 42 of the lower bracket 26*b* can extend upward. In one aspect, the lobes 42 can comprise a ferromagnetic material, such as a metal with iron. In another aspect, the bracket 26*a* and 26*b* can comprise a ferromagnetic material, such as a magnet. The bracket 26*a* and 26*b* can be formed by stamping from bar stock. Various different brackets can be provided with various different widths and various different numbers of lobes 42 to accommodate different prints with different widths.

The print hanger 10 can also comprise a pair of cover plates, such as an upper cover plate 30*a* and a lower cover plate 30*b*. The cover plates 30*a* and 30*b* are separate from one another and correspond to the pair of brackets 26*a* and 26*b*, respectively. Thus, each cover plate 30*a* and 30*b* is associated with a different one of the pair of brackets 26*a* and 26*b*. The corresponding cover plates 30 and brackets 26 can be selectively and removably joined together. Thus, the corresponding cover plates 30 and brackets 26 can have a joined configuration and a separated configuration. In addition, the cover plates 30 can substantially cover and hide the corresponding brackets 26. Thus, the cover plates 30 can provide an aesthetic finished appearance, while the brackets 26 can provide a utilitarian mount to the wall 18. Together, a cover plate 30 and a bracket 26 form a clamp to grip an edge 46 of the print 14. In another aspect, the brackets 26 can be thin, for example 1/16 inch, so that the print 14 is positioned close to the wall 18 to resist a larger gap that can allow the print 14 to be snagged. In another aspect, the edge 46 of the print 14 can be held against the wall 18 by the lobes 42 of the bracket 26. In another aspect, the print 14 can abut to the wall 18 to resist air flow from disturbing the print 14.

Each cover plate 30*a* and 30*b* can have an array of magnets 50 carried by the cover plate 30 and positioned to align with the array of lobes 42 of a corresponding bracket 26*a* and 26*b*. Thus, the cover plate 30 can magnetically attach to the bracket 26 by the magnetic force of the magnets 50 and the lobes 42. In addition, the cover plate 30 and the bracket 26 can receive the edge 46 of the print 14 therebetween, and between the magnets 50 and the lobes 42. The magnets 50 can be formed of a ferromagnetic material, such as neodymium. In one aspect, the array of magnets 50 can be received in an array of bores 54 (FIG. 6) in the cover plate 30 and secured with adhesive. In another aspect, an array of grip pads 58 can be carried by the cover plate 30 and positioned over the array of magnets 50. The grip pads 58 can comprise a non-abrasive, high-friction, contoured surface (FIG. 10), such as CatTongue™ grips, adhered over the magnets 50. The grip pads 58 can resist slippage of the edge 46 of the print 14 from between the cover plate 30 and the bracket 26, and the magnets 50 and the lobes 42. In one aspect, the bores 54 can be countersunk bores and the grip pads 58 can be positioned in the countersunk bores 54 over the magnets 50 so that the grip pads 58 can be flush with a surface or bottom of the pocket 62, described below.

In another aspect, each cover plate 30 can have a pocket 62 sized and shaped to receive a corresponding bracket 26. Thus, the pocket 62 can have a perimeter or majority of a perimeter substantially matching a perimeter or a majority of a perimeter of the bracket 26. The pocket 62 can have a depth at least as great as a thickness of the corresponding bracket 26. In one aspect, the depth of the pocket 62 can be greater than the thickness of the bracket 26 to accommodate thickness of the print 14 and/or the grip pads 58. Thus, a back surface 66 of the cover plate 30 can be substantially flush with a back surface 70 of the bracket 26. In addition, the back surface 66 of the cover plate 30 can abut to the wall 18. Thus, the pocket 62 of the cover plate 30 can entirely receive the bracket 26 therein, and cover and hide the cover plate 26. The cover plate 30 can also have a rear opening 74 in the back surface 66 that is open to the pocket 62 to receive the corresponding bracket 26 through the rear opening 74 and into the pocket 62. The pocket 62 and the rear opening 74 can be bounded by lateral sides and a top (or bottom depending on orientation) of the cover plate 30.

In addition, the cover plate 30 can have an outer opening 78 in an opposing edge 82 that is open to the pocket 62 to receive the edge 46 of the print 14 through the outer opening 78 and into the pocket 62. The outer opening 78 can be a lower outer opening 78*a* facing downward and opposite the top of the cover plate 30*a*, or an upper outer opening 78*b* facing upward and opposite the bottom of the cover plate 30*b*. The upper and lower cover plates 30*a* and 30*b* can be oriented with opposing outer openings 78*a* and 78*b* opposing one another. An upper edge 46*a* of the print 14 can extend into the opposing outer opening 78*a* of the upper cover plate 30*a* and can be sandwiched between and retained by the array of magnets 50 of the upper cover plate 30*a* and the lobes 42 of the upper bracket 26*a*. Similarly, a lower edge 46*b* of the print 14 can extend into the opposing outer opening 78*b* of the lower cover plate 30*b* and can be sandwiched between and retained by the array of magnets 50 of the lower cover plate 30*b* and the lobes 42 of the lower bracket 26*b*.

In another aspect, each cover plate 30 can have an elongated indentation 86 and aligned with a corresponding array of slots 38 in the bracket 26. Thus, the elongated indentation 86 can accommodate heads of the fasteners 34.

In another aspect, the cover plate 30 can be formed of a different material than a corresponding bracket 26. For example, the cover plate 30 can be formed of wood, and can be formed by milling, or cutting and routing. The wood can be stained and finished for an aesthetic finish. As another aspect, the cover plate 30 can be formed of plastic, and can be formed by injection molding.

In use, the print hanger 10 can have the upper bracket 26*a* and the lower bracket 26*b* mounted to the wall 18 with the fasteners 34 and in a spaced-apart relationship with respect to one another with the upper bracket 26*a* mounted over the lower bracket 26*b*. The upper and lower brackets 26*a* and 26*b* can be oriented parallel and horizontal, and with the lobes 42 facing or extending toward one another. The upper cover plate 30*a* and the lower cover plate 30*b* are carried by the upper bracket 26*a* and the lower bracket 26*b*, respectively. The upper bracket 26*a* is received within the pocket 62 of the upper cover plate 30*a* with the upper cover plate 30*a* covering the top and lateral sides of the upper bracket 26*a* and with the rear surface 66 of the upper cover plate 30*a* flush with the rear surface 70 of the upper bracket 26*a* and abutting to the wall 18. Similarly, the lower bracket 26*b* is received within the pocket 62 of the lower cover plate 30*b* with the lower cover plate 30*b* covering the bottom and lateral sides of the lower bracket 26*b* and with the rear surface 66 of the lower cover plate 30*b* flush with the rear surface 70 of the lower bracket 26*b* and abutting to the wall 18.

As described above, the upper and lower brackets 26*a* and 26*b* can be oriented with the lobes 42 facing toward one another. Similarly, the upper and lower cover plates 30*a* and 30*b* can be oriented with the outer openings 78*a* and 78*b* facing an opposing one another. The upper edge 46*a* of the print 14 extends into the outer opening 78*a* of the upper cover plate 30 while the lower edge 46*b* of the print 14 extends into the outer opening 78*b* of the lower cover plate 30.

In one aspect, the lobes 42 can extend from an elongated edge 90 (FIG. 5), such as a bottom edge of the upper bracket 26*a* and a top edge of the lower bracket 26*b*. The elongated edge 90 can have elongated straight edges between adjacent lobes 42 that are wider than the lobes 42. To hang the hangers 20 and 22, a height of the print 14 can be measured and marked on the wall 18. The upper bracket 26*a* can be positioned, leveled and secured to the wall 18 with the elongated edge 90 at a top mark, while the lower bracket 26*b* can be positioned, leveled and secured to the wall 18 with the elongated edge 90 at a bottom mark. The upper edge 46*a* of the print 14 can be positioned at the elongated edge 90 of the upper bracket 26*a* and overlapping the lobes 42 while the upper cover plate 30*a* is secured to the upper bracket 26*a*, sandwiching the upper edge 46*a* of the print 14 between the magnets 50 and the lobes 42. Similarly, the lower edge 46*b* of the print 14 can be positioned at the elongated edge 90 of the lower bracket 26*b* and overlapping the lobes 42 while the lower cover plate 30*b* is secured to the lower bracket 26*b*, sandwiching the lower edge 46*b* of the print 14 between the magnets 50 and the lobes 42.

In another aspect, the print 14 can be hung with a single hanger, such as upper hanger 20.

In another aspect, the print 14 can be hung from its sides with a pair of hangers oriented vertically on both sides of the print.

As used in this specification and the appended claims, the singular forms "a," "an" and "the" include plural referents unless the context clearly dictates otherwise. Thus, for example, reference to "a layer" includes a plurality of such layers.

In this disclosure, "comprises," "comprising," "containing" and "having" and the like can have the meaning ascribed to them in U.S. Patent law and can mean "includes," "including," and the like, and are generally interpreted to be open ended terms. The terms "consisting of" or "consists of" are closed terms, and include only the components, structures, steps, or the like specifically listed in conjunction with such terms, as well as that which is in accordance with U.S. Patent law. "Consisting essentially of" or "consists essentially of" have the meaning generally ascribed to them by U.S. Patent law. In particular, such terms are generally closed terms, with the exception of allowing inclusion of additional items, materials, components, steps, or elements, that do not materially affect the basic and novel characteristics or function of the item(s) used in connection therewith. For example, trace elements present in a composition, but not affecting the composition's nature or characteristics would be permissible if present under the "consisting essentially of" language, even though not expressly recited in a list of items following such terminology. When using an open ended term in the specification, like "comprising" or "including," it is understood that direct support should be afforded also to "consisting essentially of" language as well as "consisting of" language as if stated explicitly and vice versa.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Similarly, if a method is described herein as comprising a series of steps, the order of such steps as presented herein is not necessarily the only order in which such steps may be performed, and certain of the stated steps may possibly be omitted and/or certain other steps not described herein may possibly be added to the method.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments described herein are, for example, capable of operation in other orientations than those illustrated or otherwise described herein.

The term "coupled," as used herein, is defined as directly or indirectly connected in an electrical or nonelectrical manner. Objects described herein as being "adjacent to" each other may be in physical contact with each other, in close proximity to each other, or in the same general region or area as each other, as appropriate for the context in which the phrase is used. Occurrences of the phrase "in one embodiment," or "in one aspect," herein do not necessarily all refer to the same embodiment or aspect.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. For example, a composition that is "substantially free of" particles would either completely lack particles, or so nearly completely lack particles that the effect would be the same as if it completely lacked particles. In other words, a composition that is "substantially free of" an ingredient or element may still actually contain such item as long as there is no measurable effect thereof.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

As used herein, the term "about" is used to provide flexibility to a numerical range endpoint by providing that a given value may be "a little above" or "a little below" the endpoint. It is understood that express support is intended for exact numerical values in this specification, even when the term "about" is used in connection therewith.

The term "ferromagnetic" is used herein to refer to a material or element that has magnetic properties and/or an ability to magnetically couple, either by being magnetic, or being magnetically attracted to a magnet (such as by containing iron) such that one ferromagnetic material or element is magnetically attracted to another ferromagnetic material or element. Thus, a ferromagnetic element is a magnet or is magnetic, such as a permanent magnet, or is attracted to magnets, such as by containing iron.

It is to be understood that the examples set forth herein are not limited to the particular structures, process steps, or materials disclosed, but are extended to equivalents thereof as would be recognized by those ordinarily skilled in the relevant arts. It should also be understood that terminology employed herein is used for the purpose of describing particular examples only and is not intended to be limiting.

Furthermore, the described features, structures, or characteristics may be combined in any suitable manner in one or more examples. In the description, numerous specific details are provided, such as examples of lengths, widths, shapes, etc., to provide a thorough understanding of the technology being described. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the foregoing examples are illustrative of the principles of the invention in one or more particular applications, it will be apparent to those of ordinary skill in the art that numerous modifications in form, usage and details of implementation can be made without the exercise of inventive faculty, and without departing from the principles and concepts described herein. Accordingly, it is not intended that the invention be limited, except as by the claims set forth below.

What is claimed is:

1. A print hanger configured to hang a print on a wall, the print hanger comprising:

a) a pair of brackets separate from one another and configured to be mounted to a wall in a spaced-apart relationship, and including an upper bracket and a lower bracket;

b) each bracket comprising an array of lobes with the lobes configured to extend towards another bracket when mounted on the wall, the lobes comprising a ferromagnetic material;

c) a pair of cover plates separate from one another and corresponding to the pair of brackets with each cover plate associated with a different one of the pair of brackets, and including an upper cover plate and a lower cover plate, each cover plate comprising;

d) an array of magnets carried by the cover plate and aligning with the array of lobes of a corresponding bracket and configured to receive an edge of the print between the array of magnets and the array of lobes;

e) a pocket sized and shaped to receive one of the pair of brackets, the pocket having a depth at least as great as a thickness of a corresponding bracket, a back surface of the cover plate being substantially flush with a back surface of the bracket;

e) a rear opening in the back surface of the cover plate and open to the pocket to receive the corresponding bracket through the rear opening and into the pocket;

f) an outer opening in an opposing edge of the cover plate and open to the pocket configured to receive an edge of the print through the outer opening and into the pocket; and i) the corresponding cover plate and bracket having a joined configuration and a separated configuration.

2. The print hanger in accordance with claim 1, further comprising:

an array of grip pads carried by each cover plate and positioned over a corresponding array of magnets.

3. The print hanger in accordance with claim 1, further comprising:

a) an array of slots in each of the pair of brackets configured to receive fasteners to mount the bracket to the wall; and b) an elongated indentation in each of the pair of cover plates aligned with a corresponding array of slots configured to accommodate heads of the fasteners.

4. The print hanger in accordance with claim 1, wherein a corresponding bracket and cover plate are formed of different materials.

5. The print hanger in accordance with claim 1, in combination with a wall carrying the print hanger and a print carried by the print hanger, and further comprising:

a) the upper bracket and the lower bracket mounted to the wall and spaced-apart from one another with the upper bracket mounted above the lower bracket;

b) the upper and lower brackets oriented with the lobes facing toward one another;

c) the upper cover plate and the lower cover plate carried by the upper bracket and the lower bracket, respectively;

d) the upper and lower cover plates oriented with outer openings opposing one another;

e) an upper edge of the print extending into the outer opening of the upper cover plate and sandwiched between and retained by the array of magnets of the upper cover plate and the lobes of the upper bracket;

f) a lower edge of the print extending into the outer opening of the lower cover plate and sandwiched between and retained by the array of magnets of the lower cover plate and the lobes of the lower bracket;

g) the upper bracket received within the pocket of the upper cover plate with the upper cover plate covering a top and lateral sides of the upper bracket and with the rear surface of the upper cover plate flush with the rear surface of the upper bracket; and h) the lower bracket received within the pocket of the lower cover plate with the lower cover plate covering a bottom and lateral sides of the lower bracket and with the rear surface of the lower cover plate flush with the rear surface of the lower bracket.

6. A print hanger configured to hang a print on a wall, the print hanger comprising:

a) an upper bracket configured to be mounted to a wall;

b) the upper bracket comprising an array of lobes with the lobes extending from the upper bracket, the lobes comprising a ferromagnetic material;

c) an upper cover plate selectively and removably coupled to the upper bracket;

d) an array of magnets carried by the upper cover plate and aligning with the array of lobes of the upper bracket and configured to receive an edge of the print between the array of magnets of the upper cover plate and the array of lobes of the upper bracket;

e) the upper cover plate and the upper bracket having a joined configuration and a separated configuration;

f) a lower bracket configured to be mounted to the wall with the upper bracket mounted above the lower bracket;

g) the lower bracket comprising an array of lobes extending towards the upper bracket;

h) a lower cover plate selectively and removably coupled to the lower bracket; and i) an array of magnets carried by the lower cover plate and aligning with the array of lobes of the lower bracket and configured to receive a lower edge of the print between the array of magnets of the lower cover plate and the array of lobes of the lower bracket.

7. The print hanger in accordance with claim 6, wherein each of the upper and lower cover plates further comprise:

a) a pocket in the cover plate sized and shaped to receive a respective bracket, the pocket having a depth at least as great as a thickness of the respective bracket, a back surface of the cover plate being substantially flush with a back surface of the respective bracket;

b) a rear opening in the back surface of the cover plate and open to the pocket to receive the respective bracket through the rear opening and into the pocket; and c) an outer opening in an edge of the cover plate and open to the pocket configured to receive an edge of the print through the outer opening and into the pocket.

8. The print hanger in accordance with claim 6, further comprising:

an array of grip pads carried by each of the upper and lower cover plates and positioned over the array of magnets.

9. The print hanger in accordance with claim 6, further comprising:

a) an array of slots in each of the upper and lower brackets configured to receive fasteners to mount the brackets to the wall; and b) an elongated indentation in each of the upper and lower cover plates aligned with the array of slots configured to accommodate heads of the fasteners.

10. The print hanger in accordance with claim 6, wherein the upper and lower brackets are formed of different material than the upper and lower cover plates.

11. The print hanger in accordance with claim 6, in combination with a wall carrying the print hanger and a print carried by the print hanger, and further comprising:

a) the upper bracket and the lower bracket mounted to the wall and spaced-apart from one another with the upper bracket mounted over the lower bracket;

b) the upper and lower brackets oriented with the lobes facing toward one another;

c) the upper cover plate and the lower cover plate carried by the upper bracket and the lower bracket, respectively;

d) the upper and lower cover plates oriented with the outer openings opposing one another;

e) an upper edge of the print extending into the outer opening of the upper cover plate and sandwiched between and retained by the array of magnets of the upper cover plate and the lobes of the upper bracket;

f) a lower edge of the print extending into the outer opening of the lower cover plate and sandwiched between and retained by the array of magnets of the lower cover plate and the lobes of the lower bracket;

g) the upper bracket received within the pocket of the upper cover plate with the upper cover plate covering a top and lateral sides of the upper bracket and with the rear surface of the upper cover plate flush with the rear surface of the upper bracket; and h) the lower bracket received within the pocket of the lower cover plate with the lower cover plate covering a bottom and lateral sides of the lower bracket and with the rear surface of the lower cover plate flush with the rear surface of the lower bracket.

12. A print hanger configured to hang a print on a wall, the print hanger comprising:

a) an upper bracket configured to be mounted to a wall;

b) the upper bracket comprising a ferromagnetic material;

c) an upper cover plate selectively and removably coupled to the upper bracket;

d) magnets carried by the upper cover plate and configured to receive an edge of the print between the magnets of the upper cover plate and the upper bracket;

e) the upper cover plate and the upper bracket having a joined configuration and a separated configuration;

f) a lower bracket configured to be mounted to the wall with the upper bracket mounted above the lower bracket;

g) the lower bracket comprising a ferromagnetic material;

h) a lower cover plate selectively and removably coupled to the lower bracket;

i) magnets carried by the lower cover plate and configured to receive a lower edge of the print between the magnets of the lower cover plate and the lower bracket;

wherein each of the upper cover plate and the lower cover plate further comprises:

a pocket sized and shaped to receive a respective bracket, the pocket having a depth at least as great as a thickness of the respective bracket, a back surface of the cover plate being substantially flush with a back surface of the respective bracket;

a rear opening in the back surface of the cover plate and open to the pocket to receive the respective bracket through the rear opening and into the pocket; and an outer opening in an edge of the cover plate and open to the pocket and configured to receive an edge of the print through the outer opening and into the pocket.

13. The print hanger in accordance with claim 12, further comprising:

a) the brackets each comprising an array of lobes with the lobes comprising the ferromagnetic material; and b) the magnets being an array of magnets carried by the cover plates and aligning with the array of lobes of the brackets and configured to receive an edge of the print between the array of magnets and the array of lobes.

14. The print hanger in accordance with claim 13, further comprising:

an array of grip pads carried by the cover plate and positioned over the array of magnets.

15. The print hanger in accordance with claim 12, further comprising:

a) an array of slots in each of the brackets configured to receive fasteners to mount the bracket to the wall; and b) an elongated indentation in each of the cover plates aligned with the array of slots and configured to accommodate heads of the fasteners.

16. The print hanger in accordance with claim 12, wherein the upper and lower brackets are formed of different material than the upper and lower cover plates.

17. The print hanger in accordance with claim 13, in combination with a wall carrying the print hanger and a print carried by the print hanger, and further comprising:

a) the upper bracket and the lower bracket mounted to the wall and spaced-apart from one another with the upper bracket mounted over the lower bracket;

b) the upper and lower brackets oriented with the lobes facing toward one another;

c) the upper cover plate and the lower cover plate carried by the upper bracket and the lower bracket, respectively;

d) the upper and lower cover plates oriented with the outer openings opposing one another;

e) an upper edge of the print extending into the outer opening of the upper cover plate and sandwiched between and retained by the array of magnets of the upper cover plate and the lobes of the upper bracket;

f) a lower edge of the print extending into the outer opening of the lower cover plate and sandwiched between and retained by the array of magnets of the lower cover plate and the lobes of the lower bracket;

g) the upper bracket received within the pocket of the upper cover plate with the upper cover plate covering a top and lateral sides of the upper bracket and with the rear surface of the upper cover plate flush with the rear surface of the upper bracket; and h) the lower bracket received within the pocket of the lower cover plate with the lower cover plate covering a bottom and lateral sides of the lower bracket and with the rear surface of the lower cover plate flush with the rear surface of the lower bracket.

18. A print hanger configured to hang a print on a wall, the print hanger comprising:

a) a bracket configured to be mounted to a wall;

b) the bracket comprising an array of lobes with the lobes extending from the bracket, the lobes comprising a ferromagnetic material;

c) a cover plate selectively and removably coupled to the bracket;

d) an array of magnets carried by the cover plate and aligning with the array of lobes and configured to receive an edge of the print between the array of magnets and the array of lobes; and e) the cover plate and bracket having a joined configuration and a separated configuration;

f) an array of slots in the brackets configured to receive fasteners to mount the bracket to the wall; and g) an elongated indentation in the cover plate aligned with the array of slots and configured to accommodate heads of the fasteners.

* * * * *